US008398391B2

(12) United States Patent
Collison et al.

(10) Patent No.: US 8,398,391 B2
(45) Date of Patent: Mar. 19, 2013

(54) DRY-CAST CONCRETE BLOCK MOLDING MACHINE

(76) Inventors: Ryan W. Collison, Pierce, NE (US); Beau R. Collison, Pierce, NE (US)

( * ) Notice: Subject to any disclaimer, the term of this patent is extended or adjusted under 35 U.S.C. 154(b) by 239 days.

(21) Appl. No.: 12/930,094

(22) Filed: Dec. 28, 2010

(65) Prior Publication Data

US 2012/0164259 A1 Jun. 28, 2012

(51) Int. Cl.
*B28B 13/02* (2006.01)
*B28B 13/04* (2006.01)

(52) U.S. Cl. ..... 425/253; 425/469; 425/413; 425/421; 425/406; 425/145; 425/148; 425/140; 425/330; 425/256; 425/259

(58) Field of Classification Search ..... 425/140, 425/145, 148, 253, 256, 259, 261, 330, 406, 425/412, 413, 421, 447, 469; 264/333
See application file for complete search history.

(56) References Cited

U.S. PATENT DOCUMENTS 4,164,537 A * 8/1979 Drostholm et al. ..... 264/333
4,337,694 A * 7/1982 Brown ..... 100/45
5,490,363 A 2/1996 Woolford
5,503,546 A * 4/1996 Aaseth et al. ..... 425/258
5,589,124 A 12/1996 Woolford et al.
5,711,129 A 1/1998 woolford
5,827,015 A 10/1998 Woolford et al.
6,142,713 A 11/2000 Woolford et al.
6,183,168 B1 2/2001 Woolford et al.
6,312,197 B1 11/2001 Woolford et al.
6,616,382 B2 9/2003 Woolford et al.
7,156,645 B2 * 1/2007 Ness ..... 425/441
2009/0255211 A1 10/2009 Collison

* cited by examiner

*Primary Examiner* — Joseph S Del Sole
*Assistant Examiner* — Lawrence D Hohenbrink, Jr.
(74) *Attorney, Agent, or Firm* — Dennis L. Thomte; Thomte Patent Law Office LLC

(57) ABSTRACT

A dry-cast concrete block molding machine for molding concrete blocks. The machine includes a weigh hopper system which senses when the proper amount of concrete, as determined by the weight thereof, has been placed in the weigh hopper to dump the weigh hopper. The machine also includes end plates in the mold box thereof which may be interchanged so that the configuration of the concrete block may be easily changed. The machine also includes a conveyor system which not only conveys mold trays into the mold box of the machine but which also is used to push the molded block outwardly from the compaction chamber of the mold box when the block has been molded.

4 Claims, 13 Drawing Sheets

DRY-CAST CONCRETE BLOCK MOLDING MACHINE

BACKGROUND OF THE INVENTION

1. Field of the Invention

This invention relates to a dry-cast concrete block molding machine and more particularly to a dry-cast concrete block molding machine having unique features such as a concrete weigh hopper, replaceable mold plates and a conveyor which not only conveys urethane mold trays into the mold box but which also pushes the molded concrete block out of the mold box.

2. Description of the Related Art

Many types of dry-cast concrete molding or making machines have been previously provided. See for example U.S. Pat. Nos. 6,616,874 and 7,341,685. In some of the prior art machines, dry-cast concrete is conveyed into a dump box or hopper located at the upper end of the machine. A person is positioned near the dump hopper and attempts to visually determine when the proper amount of concrete for an individual block has been placed into the dump hopper. When the person believes that the correct amount of concrete has been placed into the dump hopper, the person stops the conveyor. If too much concrete has been placed in the dump hopper, the excess concrete presents a problem. If too little concrete has been placed in the dump hopper, an imperfect block will be molded requiring the imperfect block to be discarded.

A second problem associated with the prior art dry-cast concrete block molding machines is that the mold box thereof can only mold a concrete block having one configuration. If it is necessary to produce a different type of concrete block, the entire mold box of the machine must be replaced.

A third problem associated with prior art dry-cast concrete blocking molding machines is the lack of a method of conveniently conveying mold trays to the mold box and the lack of a method of conveniently removing the molded concrete blocks and the trays from the mold box.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A dry-cast concrete block molding machine is provided which includes an upstanding frame means having an upper end, a lower end, a first side, a second side, a front side and a back side. A concrete weigh hopper is positioned at the upper end of the frame means with the concrete weigh hopper having an open upper end. The concrete weigh hopper is pivotally movable from a concrete receiving position to a dumping position. A concrete conveyor for conveying dry-cast concrete is provided to supply dry-cast concrete to the upper end of the concrete weigh hopper. A concrete chute is mounted on the frame means below the concrete weigh hopper and has an open upper end and an open lower end. A shot glass assembly is positioned below the concrete chute and which is selectively horizontally movably mounted on the frame means between a first position and a second position. The shot glass assembly has an open upper end and an open lower end. The shot glass assembly, when in its first position has its open upper end positioned directly below the open lower end of the concrete chute so that dry-cast concrete dumped from the concrete weigh hopper into the open upper end of the concrete chute will pass downwardly into the open upper end of the shot glass assembly. The shot glass assembly, when in its second position, has its open upper end positioned laterally of the open lower end of the concrete chute.

A concrete mold box is mounted on the frame means and is positioned directly below the open upper end of the shot glass assembly when the shot glass assembly is in its second position. The concrete mold box includes a bottom wall, an upstanding front side, an upstanding back side, an open first side and an open second side. An upstanding first mold box end plate is selectively movably mounted on the frame means and is selectively horizontally movable on the frame means between open and closed positions relative to the mold box. The first mold box end plate, when in its closed position, closes the open first side of the mold box. An upstanding second mold box end plate is also provided which is selectively horizontally movably mounted on the frame means between open and closed positions relative to the mold box. The second mold box end plate, when in its closed position, closes the open second side of the mold box.

A first vertically disposed power cylinder is mounted on the frame means and includes a cylinder body and a cylinder rod selectively movably extending downwardly therefrom. The cylinder body of the first power cylinder is positioned above the mold box and above the shot glass assembly. The cylinder rod of the first power cylinder is selectively movable between retracted and extended positions. A compaction head is mounted on the cylinder rod of the first power cylinder so that extension of the cylinder rod of the first power cylinder causes the compaction head to move downwardly through the shot glass assembly when the shot glass assembly is in its second position, to force the dry-cast concrete therein downwardly into the mold box, when the first and second mold box end plates are in their closed positions, to compact the dry-cast concrete in the mold box. A vibrator is also utilized to vibrate the concrete in the mold box.

The first and second mold box end plates are movable from their closed positions to their open positions after the dry-cast concrete has been compacted in the mold box and the cylinder rod of the first power cylinder has been moved to its retracted position.

A horizontally disposed mold tray conveyor, having first and second ends, is positioned at the first side of the frame means for conveying the mold trays to the mold box.

The concrete weigh hopper includes a unique scale means associated therewith which will deactivate the conveyor, which is furnishing dry-cast concrete to the concrete weigh hopper, when the precise amount of concrete has been placed therein. When the precise amount of concrete has been placed within the concrete weigh hopper, the concrete weigh hopper is moved from its concrete receiving position to its dumping position to deliver the dry-cast concrete to the concrete chute.

The machine of this invention is adapted to be easily altered so as to handle and mold different types of concrete blocks. Mold plates are secured to the front and back sides of the block mold box and are removably mounted in the mold box so that they may be removed and replaced by different types of plates so as to produce different types of concrete blocks.

The conveyor at the side of the frame means not only conveys mold trays to the mold box but also is capable of pushing the molded concrete blocks from the mold box to the other side of the frame means.

It is therefore principal object of the invention to provide an improved dry-cast concrete block molding machine.

A further object of the invention is to provide a dry-cast concrete block molding machine having a unique concrete weigh hopper positioned at the upper end of the frame means which is associated with a scale so that a precise amount of dry-cast concrete is placed within the concrete weigh hopper.

A further object of the invention is to provide a dry-cast concrete block molding machine wherein the front and rear plates of the mold box may be easily removed and replaced so that the machine may produce concrete blocks having different configurations.

A further object of the invention is to provide a dry-cast concrete block molding machine including a conveyor for conveying mats to the mold box and which also pushes the molded concrete block and its mat from the mold box.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
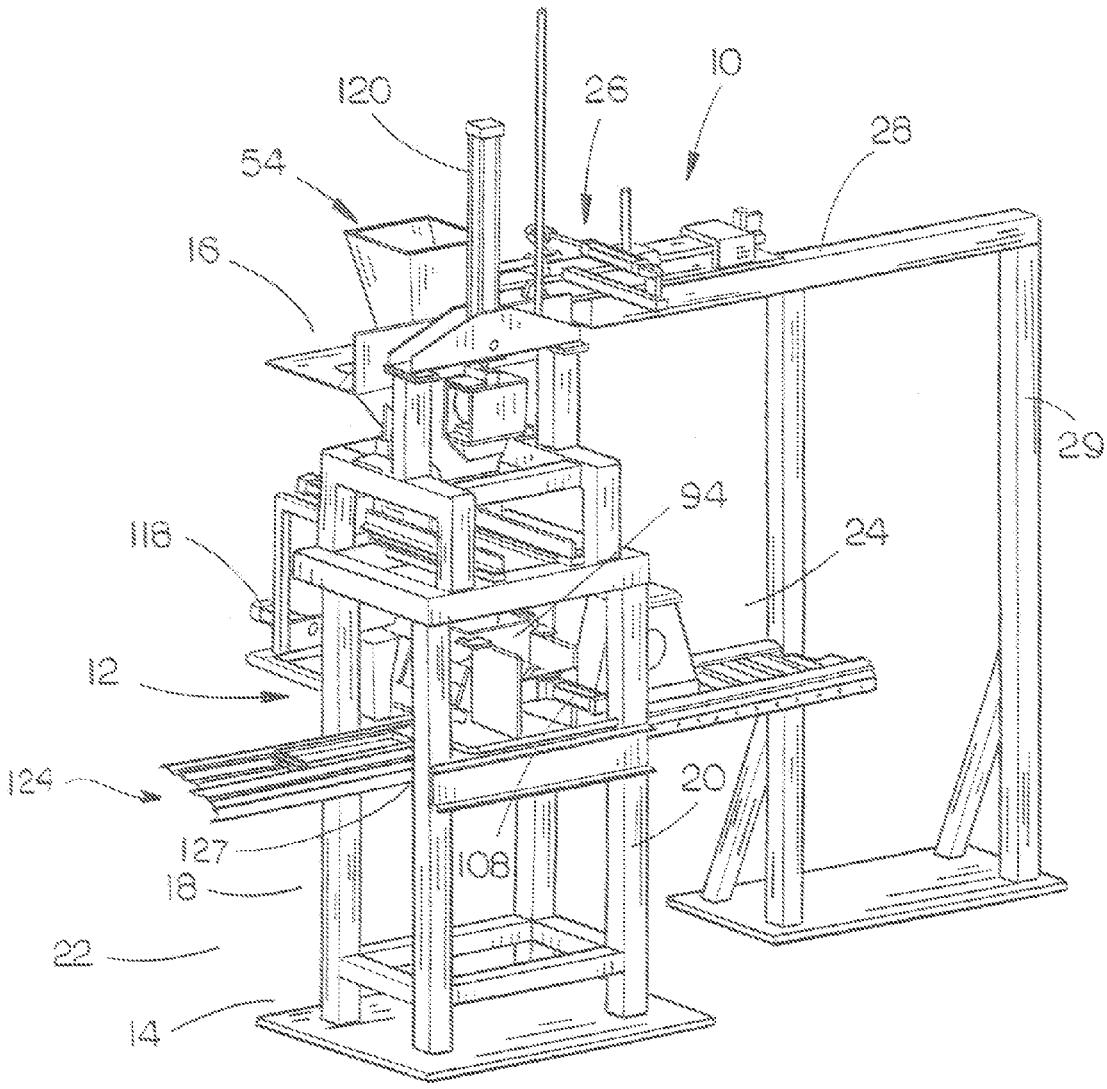
FIG. 1 is a front perspective view of the dry-cast concrete block molding machine of this invention.
Figure 2:
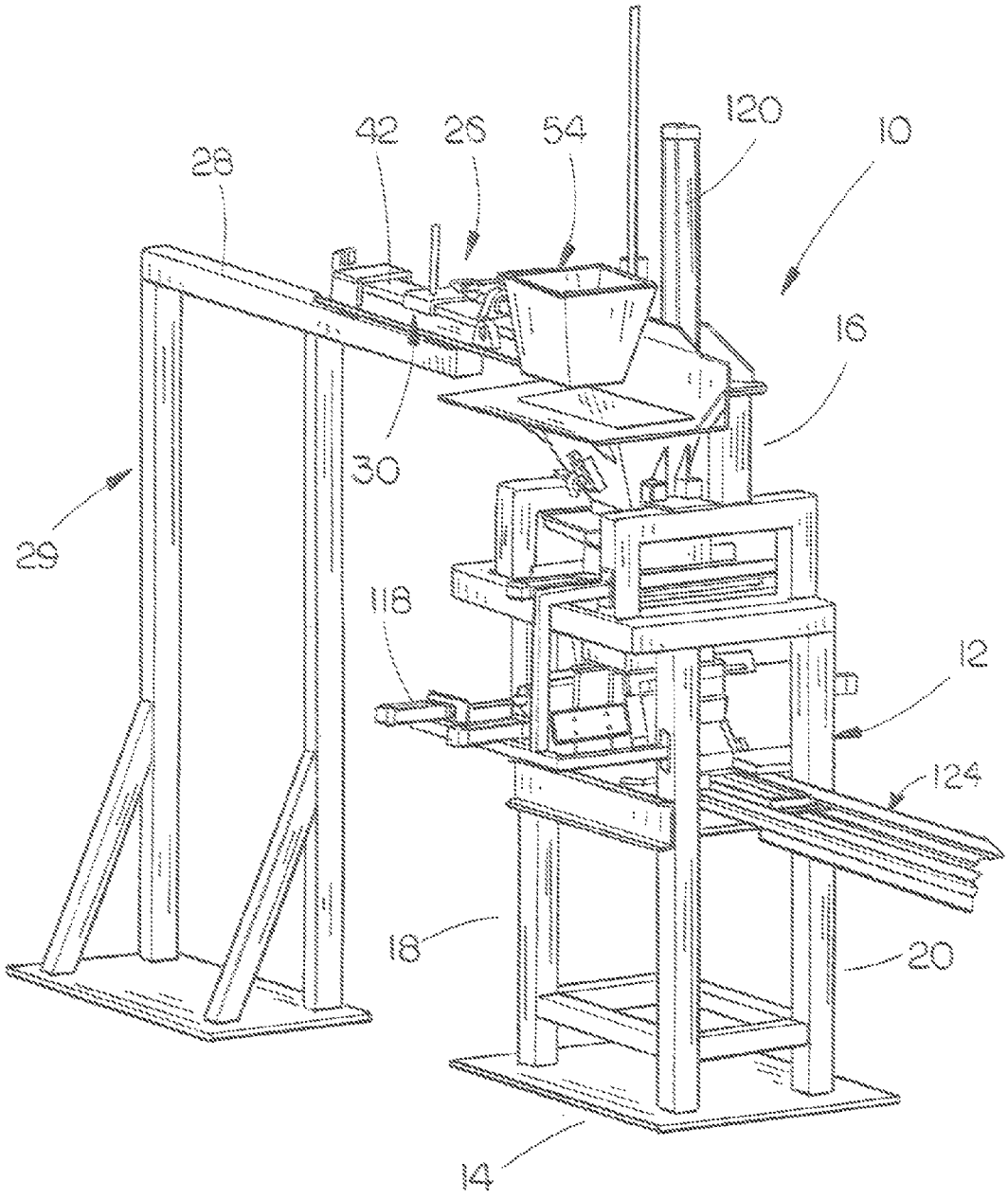
FIG. 2 is a rear perspective view of a dry-cast concrete block molding machine.
Figure 3:
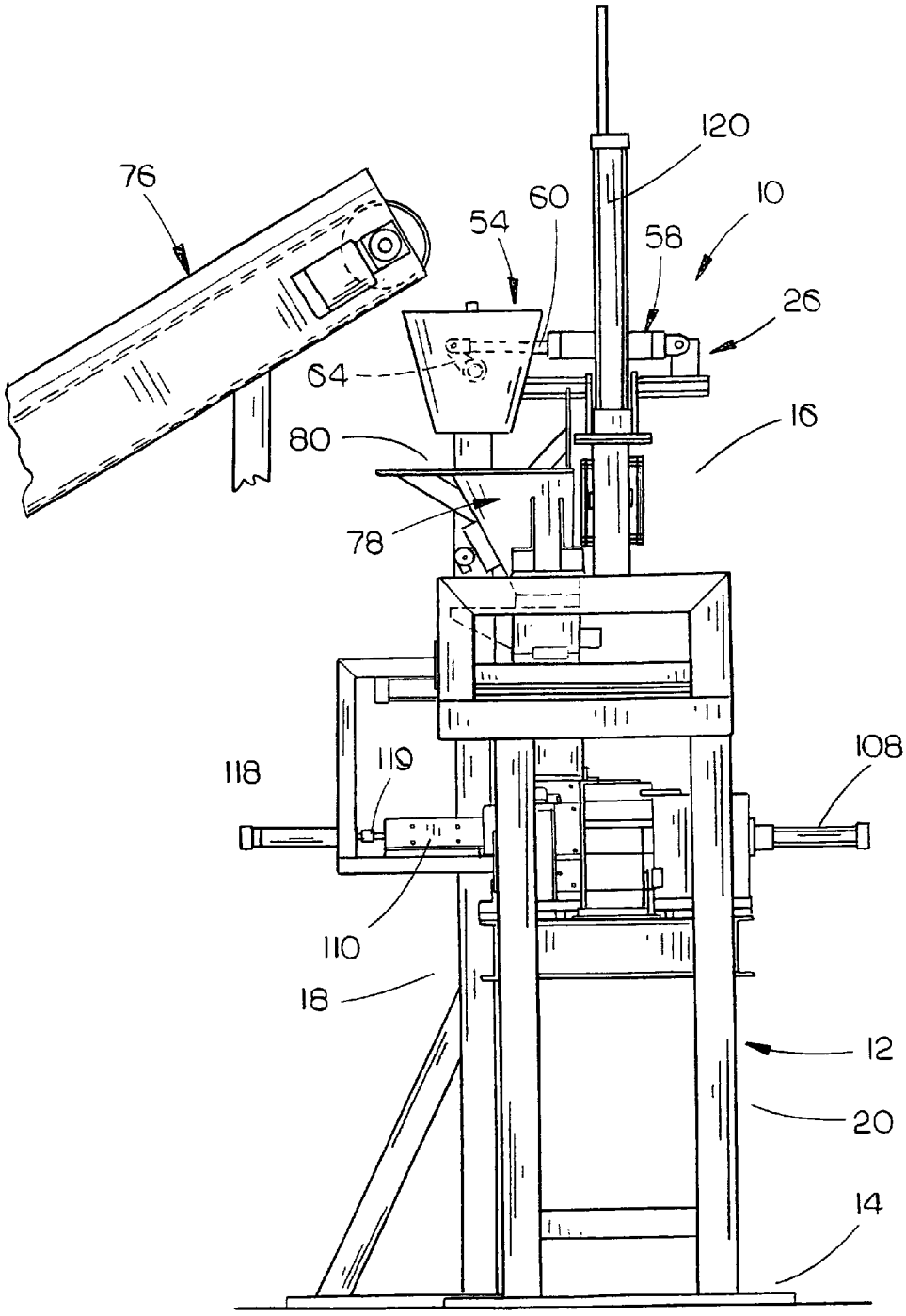
FIG. 3 is a side elevational view of the dry-cast concrete block molding machine of this invention which illustrates its relationship with respect to a dry-cast concrete conveyor.
Figure 4:
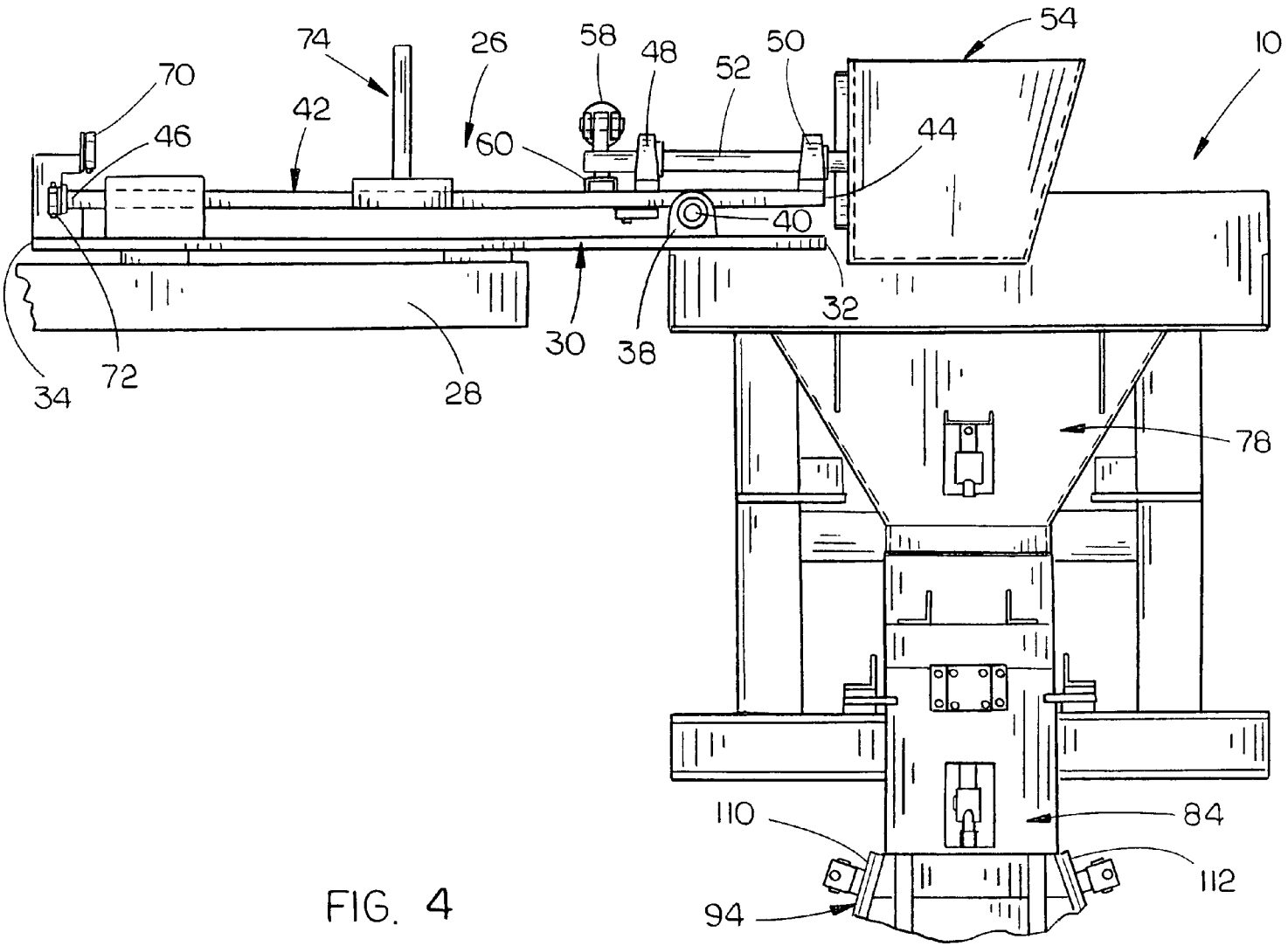
FIG. 4 is a side elevational view of the concrete weigh hopper positioned at the upper end of the frame means and its relationship to a scale.
Figure 5:
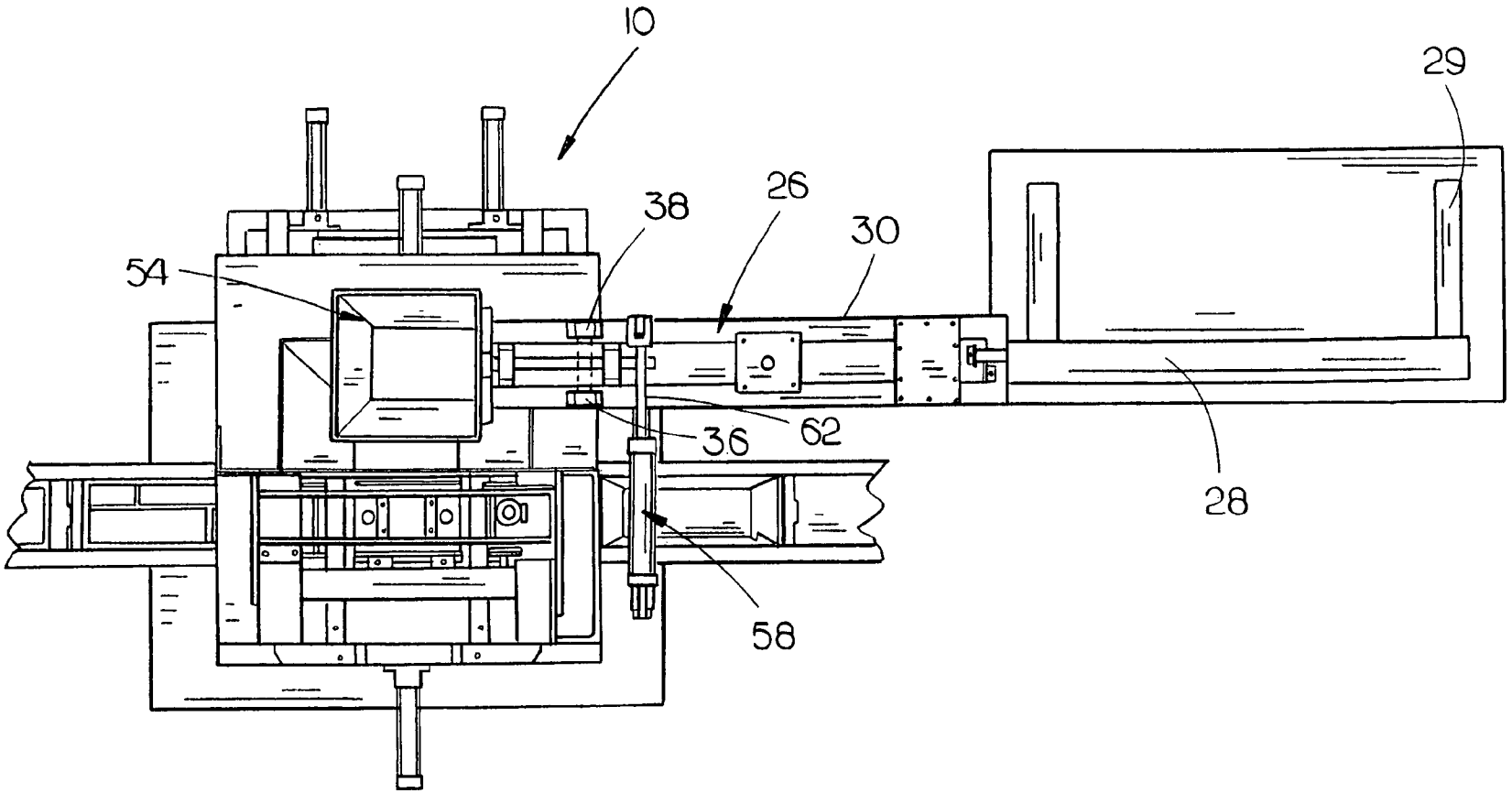
FIG. 5 is a partial top view of the dry-cast concrete block molding machine of this invention.
Figure 6:
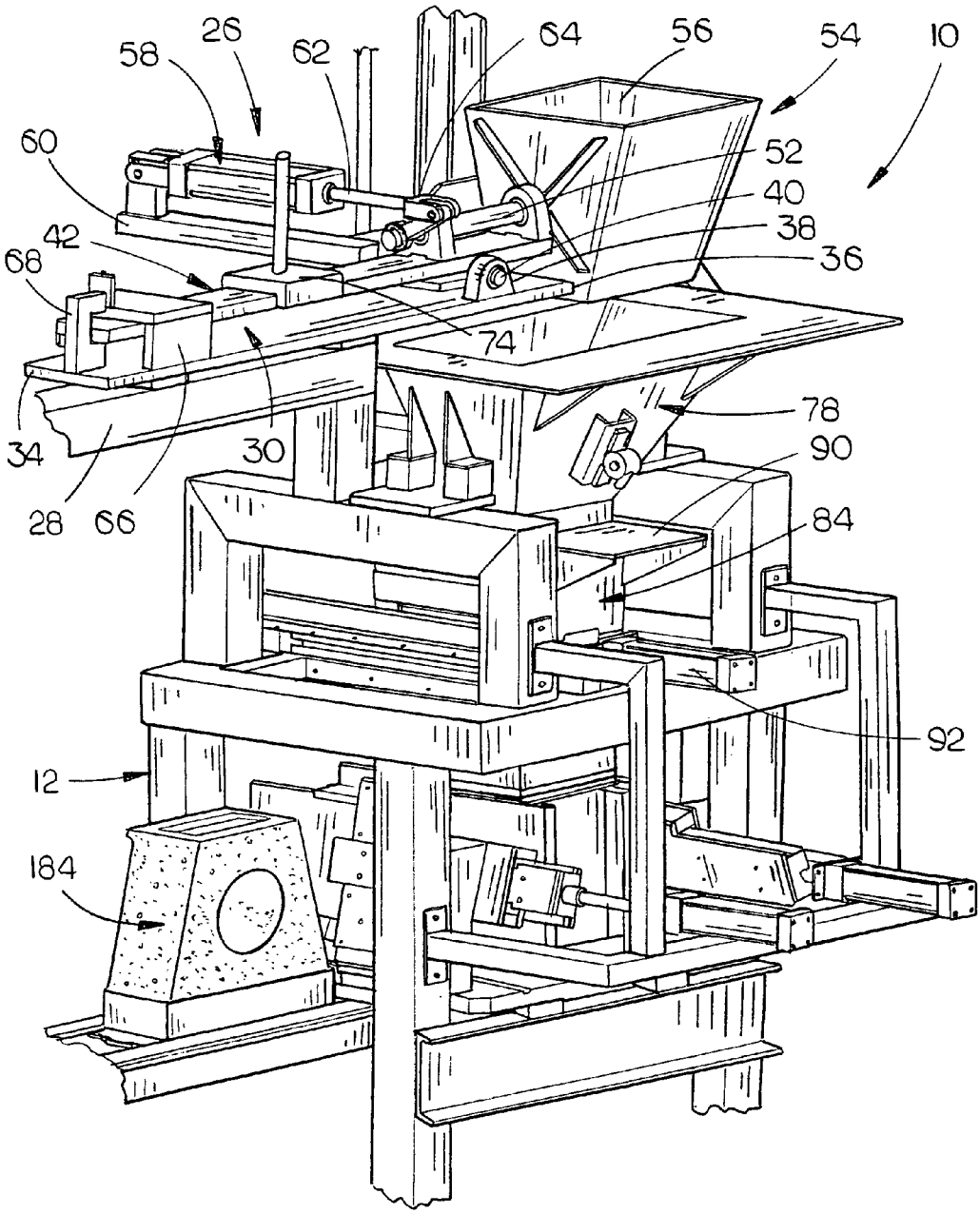
FIG. 6 is a partial rear perspective view of the dry-cast concrete block molding machine of this invention illustrating a concrete block being discharged from the machine.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The dry-cast concrete block molding machine of this invention is referred to generally by the reference numeral 10. Machine 10 includes an upstanding frame means 12 having a lower end 14, an upper end 16, a back side 18, a front side 20, a left or first side 22 and right or second side 24.

Weigh scale hopper assembly 26 is mounted on a horizontally extending frame member 28 which is supported by an upstanding frame means 29. Assembly 26 includes an elongated flat support member 30 having an inner end 32 and an outer end 34. Support member 30 is secured to frame member 28 by bolts or the like. A pair of spaced-apart bearings 36 and 38 is secured to the upper surface of support member 30 outwardly of the inner end 32 thereof. A shaft 40 is rotatably mounted in bearings 36 and 38 and extends therebetween.

An elongated flat support member or balance beam 42 is positioned above support member 30 and has an inner end 44 and an outer end 46. Shaft 40 is secured to the underside of support member 42 by any convenient means so that support member 42 may pivot with respect to support member 30 about a horizontally disposed axis transverse with respect to the longitudinal axis thereof. Horizontally spaced-apart bearings 48 and 50 are secured to support member 42 by bolts or the like. Shaft 52 is rotatably mounted in bearings 48 and 50 and extends therebetween. The inner end of shaft 52 is secured to the side of a hopper 54 having an open upper end 56 so that rotation of shaft 52 causes hopper 54 to be pivotally moved from a non-dumping position to a dumping position and vice versa. An air cylinder 58 is mounted on frame member 60 of frame means 12. The cylinder rod 62 of air cylinder 58 is pivotally secured to a yoke or connector 64 which is pivotally secured to shaft 52 so that retraction of the rod 62 will cause the hopper 54 to be pivotally moved from its non-dumping position to its dumping position. Conversely, extension of the rod 62, when hopper 54 is in its dumping position, will cause hopper 54 to be pivotally moved to its non-dumping position.

The numeral 66 refers to a support which is secured to support member 30 adjacent the outer end thereof with support member 42 extending through support 66. An upstanding plate 68 is secured at its lower end to support member 30 and extends upwardly therefrom. A normally open upper electrical switch 70 is secured to plate 68 so as to be in the upward pivotal path of the outer end of support member 42. A lower electrical switch 72 is secured to plate 68 so as to be in the pivotal path of the outer end of support member 42. The numeral 74 refers to a balance weight which is longitudinally adjustably mounted on support member 42.

The numeral 76 refers to a conventional conveyor which conveys the dry-cast concrete material to the open upper end 56 of hopper 54.

The numeral 78 refers to a hollow chute which is fixedly mounted on the frame means 12 below the hopper 54. Chute 78 has an open upper end 80 and an open lower end 82. As seen, the back wall of chute 78 tapers forwardly and downwardly.

Figure 7:
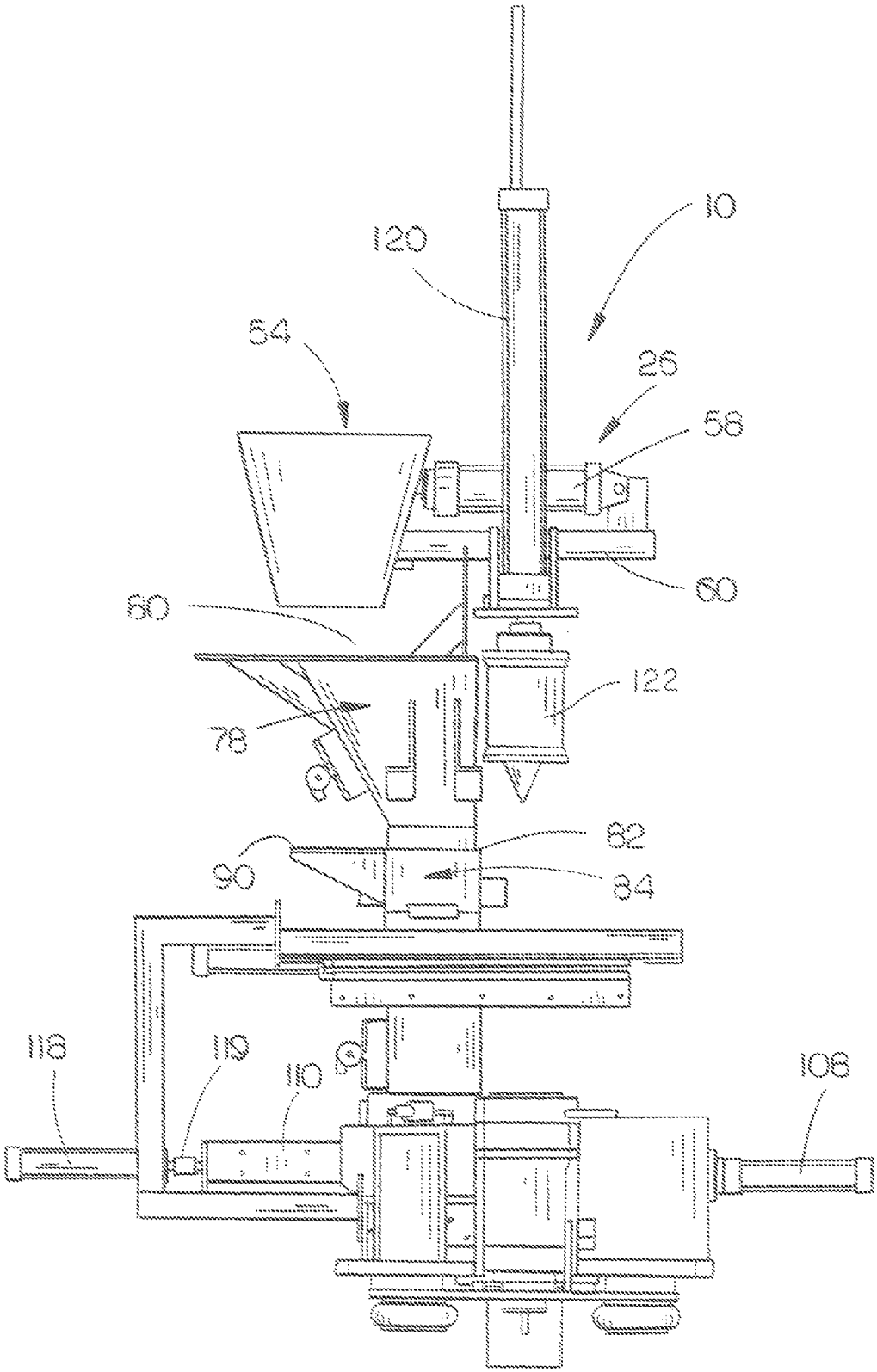
FIG. 7 is a partial side view of the dry-cast concrete block molding machine of this invention with the shot glass assembly thereof being illustrated in a first position.
Figure 8:
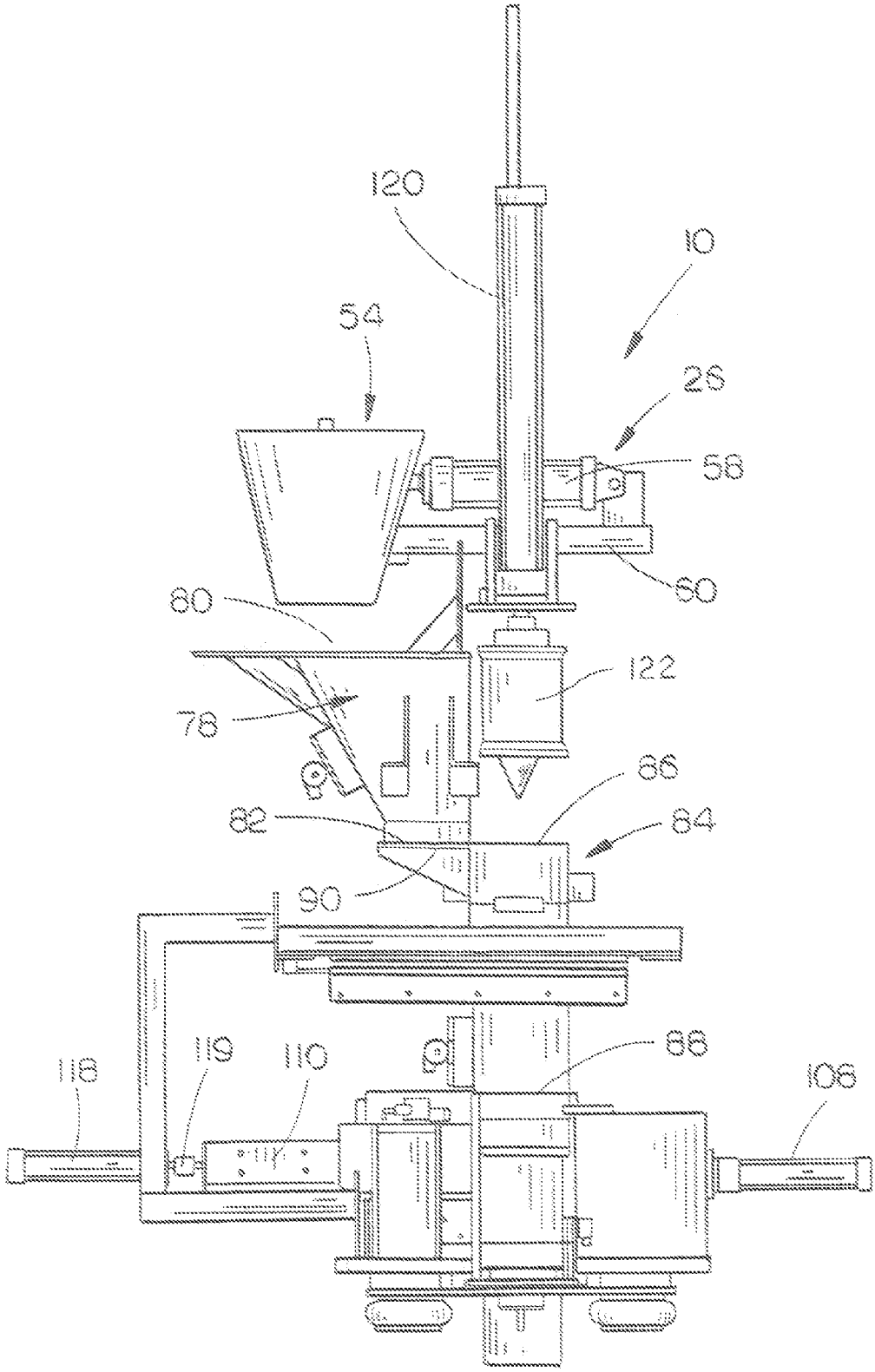
FIG. 8 is a view similar to FIG. 7 except that the shot glass assembly has been moved to a second position.
Figure 9:
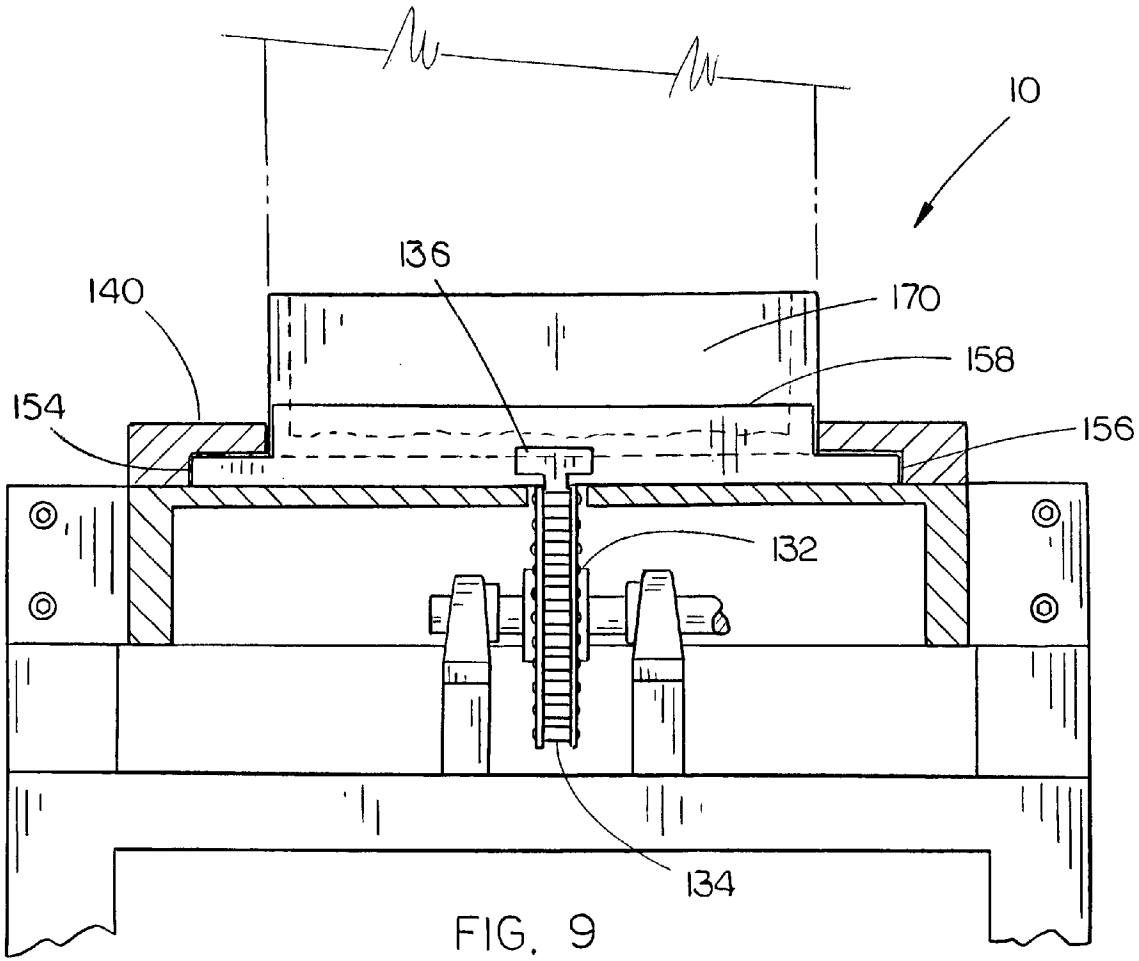
FIG. 9 is a partial sectional view of the conveyor which conveys the mats to the machine.

A shot glass 84 assembly is positioned below chute 78 and is horizontally movable from a first position as seen in FIG. 7 to a second position, as seen in FIG. 8. The shot glass 84 assembly has an open upper end 86 and an open lower end 88. A horizontally extending plate 90 is positioned at the rearward side of shot glass 84 assembly at the upper end thereof. When shot glass 84 is in its first position of FIG. 7, the plate 90 is positioned rearwardly of the lower end of chute 78. When shot glass 84 assembly is in its second position of FIG. 8, plate 90 closes the lower end 82 of chute 78. Shot glass 84 assembly is moved between its first and second positions by an air cylinder 92.

Figure 11:
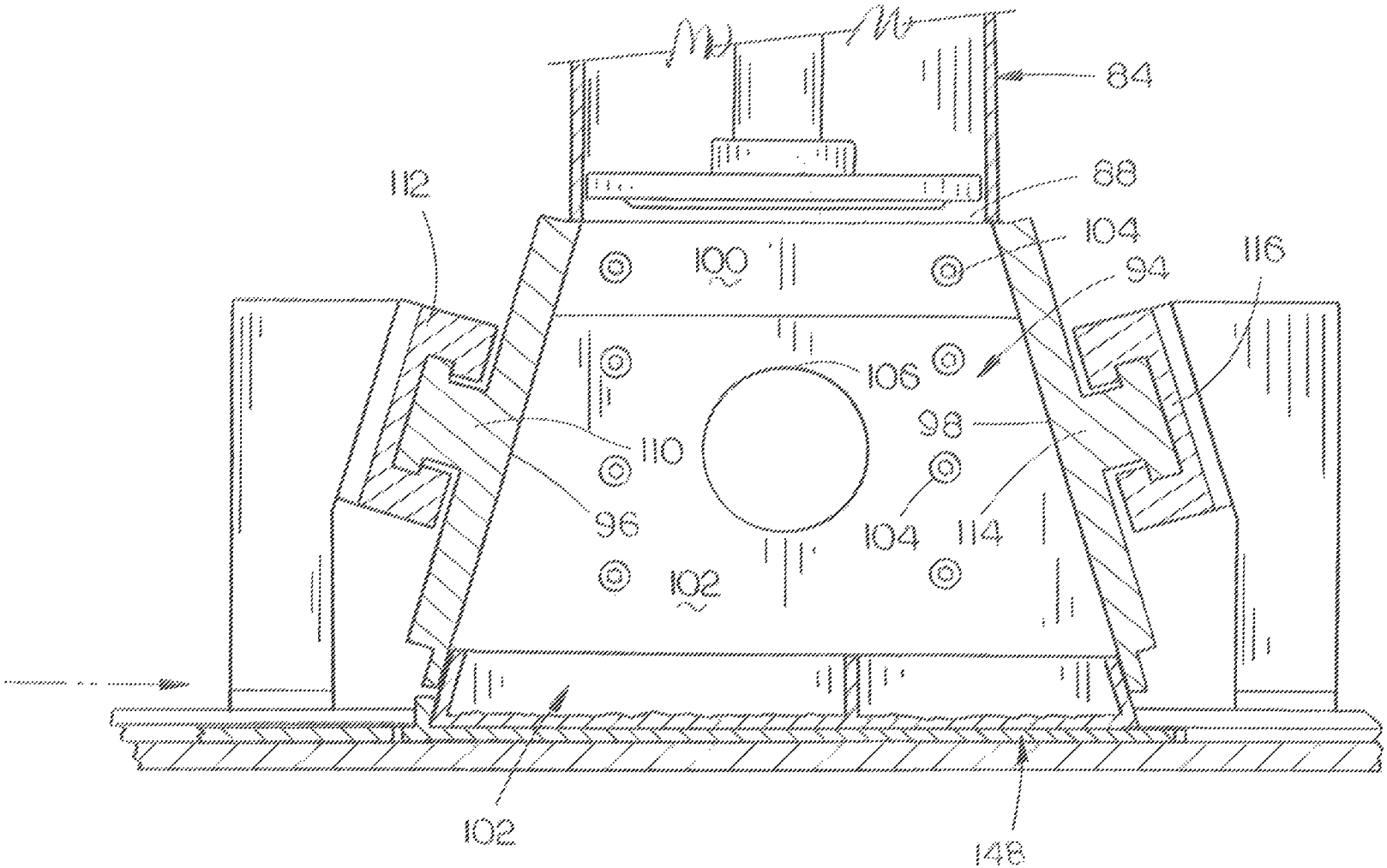
FIG. 11 is a partial sectional view of the mold box and its relationship with respect to the compaction head and a mat positioned within the mold box.
Figure 12:
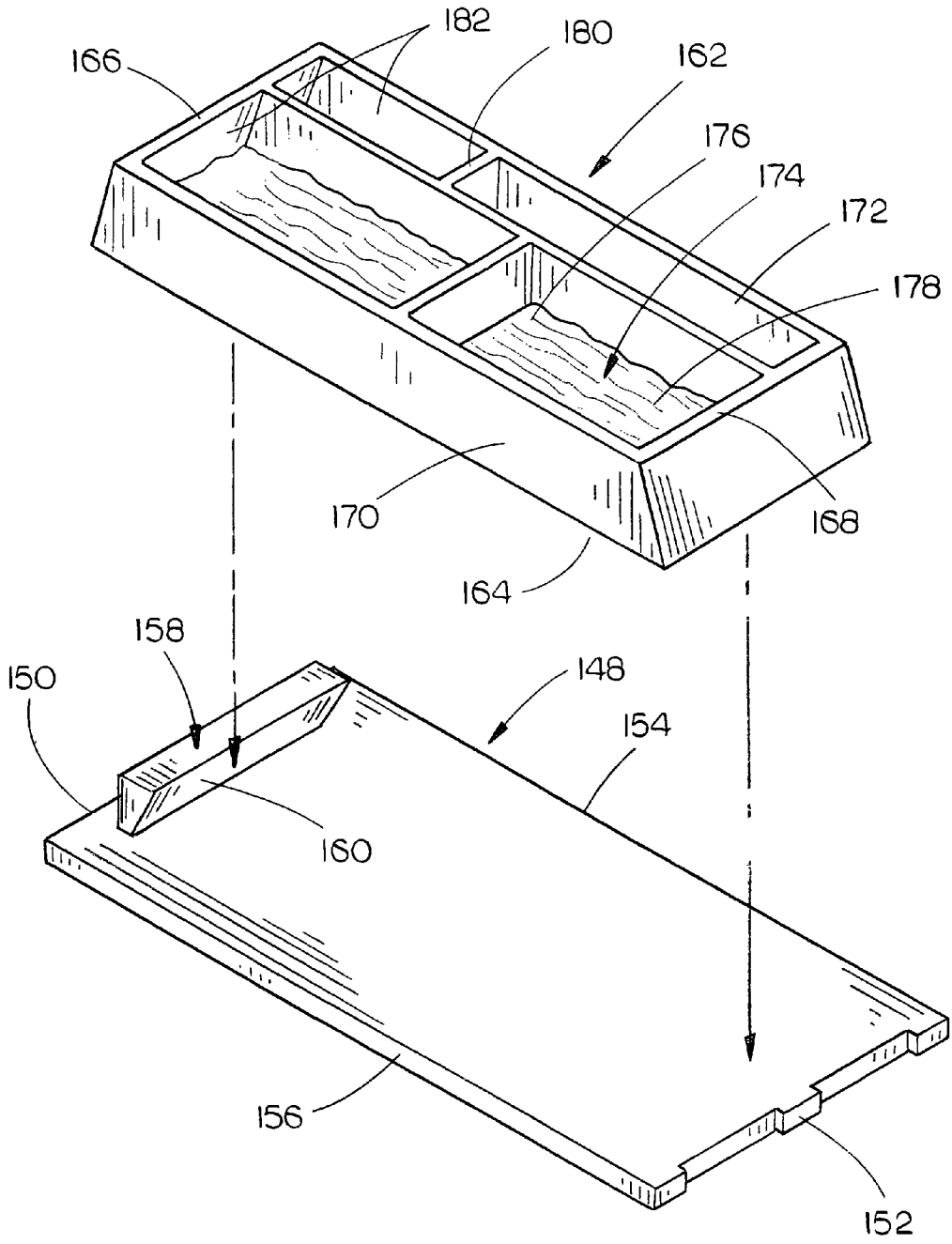
FIG. 12 is an exploded perspective view of a mat and its relationship to a pad upon which the mat is placed.
Figure 13:
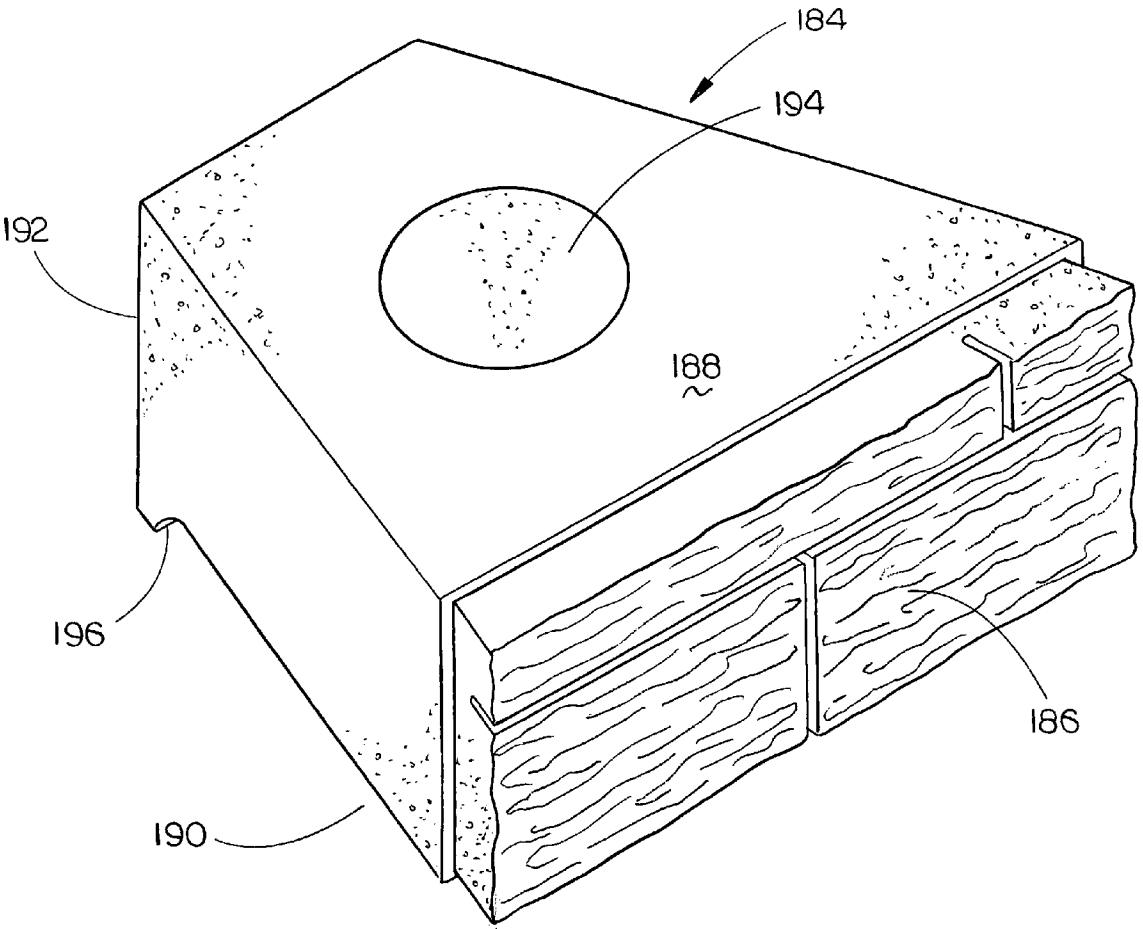
FIG. 13 is a perspective view of a finished concrete block.

A mold box 94 is positioned below shot glass assembly 84 and is in communication with the lower open end 88 of shot assembly when the shot glass assembly 84 is in its second position of FIG. 8. Mold box 94 includes a front side, a back side, a first open end 96 and a second open end 98. The back side of mold box 94 has a pair of mold plates 100 and 102 selectively removably secured thereto by screws or bolts 104. The configuration of the back side of the mold box 96 may be easily changed by substituting different mold plates for the plates 100 and 102 to change the style of the concrete block being produced. The front side of mold box 94 also has one or more mold plates selectively removably secured thereto. As seen in FIG. 11, plate 102 has a circular recess 106 formed therein. The front side of mold box and one of the mold plates thereof have a circular opening formed therein. An air cylinder 108 is mounted on the frame means 12 and has a cylindrical plug secured to its cylinder rod which is adapted to inserted through a circular opening in the front side of mold box 94, and into the circular recess 106 to form a cylindrical cavity in the block being molded.

The first open side 96 of mold box 94 is selectively dosed by a first door 110 which is horizontally slidably mounted in guide 112. The second open side 98 of mold box 94 is selectively closed by a second door 114 which is horizontally slidably mounted in guide 116. An air cylinder 118 is mounted on frame means 12 and has its cylinder rod 119 secured to the doors 110 and 114 to simultaneously open and close the doors 110 and 114.

The numeral 120 refers to a vertically disposed air cylinder which is mounted on frame means 12 above the mold box and has a compaction head 122 secured to its cylinder end which is vertically movable downwardly through shot glass assembly 84 when shot glass assembly 84 is in its second position of FIG. 8.

Figure 10:
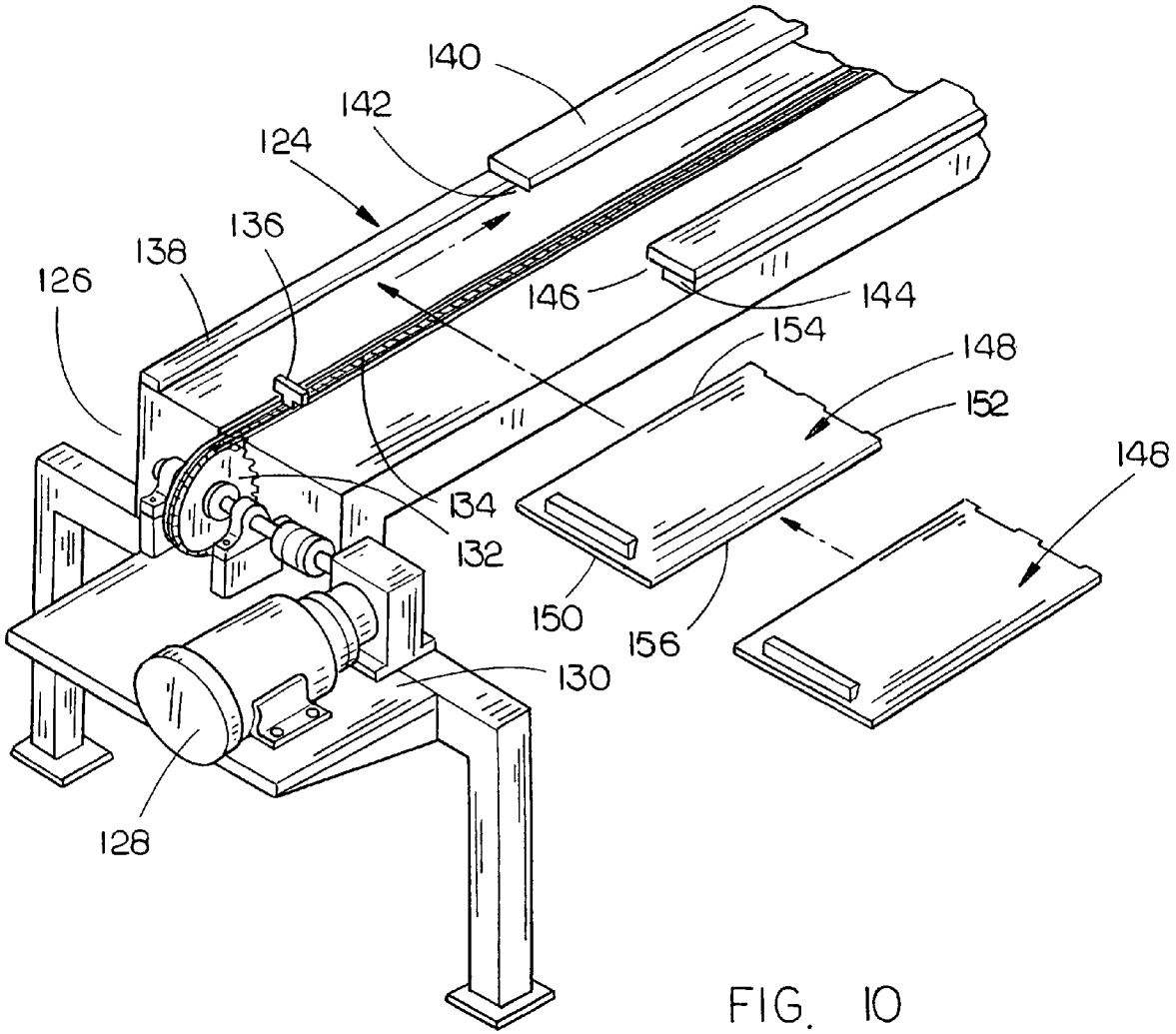
FIG. 10 is a partial perspective view illustrating the conveyor of FIG. 9.

A horizontally disposed support table 124 is positioned at the first or inlet side of the machine 10 and will be described as having an outer end 126 and an inner end 127. An electric motor 128 is mounted on frame 130 as seen in FIG. 10. Motor 128 is coupled to a sprocket 132 having a conveyor chain 134 extending therearound. The inner end of support table has a sprocket rotatably mounted thereon over which the chain 134 extends. Chain 134 has an upstanding lug or dog 136 mounted thereon. As also seen in FIG. 10, support table 124 has an elongated flat strip 138 mounted thereon at one side thereof which extends between outer and inner ends of the support table 124. A guide plate 140 is positioned on strip 138 to create a guide channel 142. As seen in FIG. 10, the outer end of plate 140 is spaced from the outer end of strip 138. As also seen in FIG. 10, the outer side of support table 124 has an elongated flat strip 144 mounted thereon which has a guide plate 146 mounted thereon to form a channel 146. As seen in FIG. 10, the outer end of strip 144 is spaced from the outer end of support table 124.

The numeral 148 refers to a metal pad having an outer end 150, an inner end 152, and opposite side edges 154 and 156. An upstanding lug 158 is secured to the upper surface of pad 148 and has a tapered inner end 160.

The numeral 162 refers to a mold tray which is comprised of urethane which is a POLYTEX® 75-70 or 75-80 material. Tray 162 includes a bottom wall 164, end walls 166 and 168, and side walls 170 and 172. Each of the walls 164, 166, 168, 170 and 172 has inside surfaces. The inside surface of bottom wall 164 has an irregular surface 174 molded therein with indentations 176 and ridges 178. If the concrete block which is to be formed by the tray 162 is to have a plurality of generally rectangular face portions, a plurality of upstanding ribs or partitions 180 are molded with the tray 162 to provide a plurality of generally rectangular face portions, a plurality of upstanding ribs or partitions 180 are molded with the tray 162 and will extend upwardly from the inside surface of bottom wall 164 to define a plurality of generally rectangular cavities 182. The tray as disclosed will be used to create a concrete block 184 having a front face 186, upper surface 188, lower surface 190, back face or surface 192, cavity 194, and set-back lip 196.

A suitable dry-cast concrete product for use with the machine 10 will be comprised of approximately 2.4% by weight water, 21.6% by weight aggregate (sand and gravel) and 15.9% by weight PORTLAND DURACEM®. A suitable compaction pressure is approximated 850 psi.

The concrete block molding machine of this invention operates as follows. In the starting position, the concrete conveyor 76 is "off". The tray conveyor 134 is "off". The tray conveyor 134 is "off". End doors 110 and 114 of the mold box 94 are "open" due to the previous retraction of the air cylinder 118. The air cylinder 108 with the plug attached to the cylinder rod thereof is in a retracted position. The vibrator for the machine is "off". The cylinder 120 is in the retracted position so that the compaction or compression head 122 is in the "up" position. The hopper 54 is in its non-dumping position. The lower switch 72 is engaged by the support member 42.

The sequential operation of the machine will now be described. A plurality of the metal pads 148 are then positioned on the support table in an end-to-end relationship with the innermost pads 148 having their side edges received by the channels 142 and 144. The mold trays 162 are then placed on the pads 148 with the outer ends thereof being in engagement with the lugs 158. The upstanding lug 136 on the conveyor chain 134 will be positioned adjacent the outer end of the outermost pad 148 on the support table 124. The main control electrical switch for the machine is then switched to the "on" position. At this time, the tray conveyor 134 is energized which pushes the pads 148 with the trays 162 thereon inwardly towards the machine. The tray conveyor 134 pushes the innermost pad 148 and tray 162 into the compaction chamber of the mold box through the open end door 110. The end doors 110 and 114 are then closed due to the extension of the air cylinder 118. The air cylinder 108 is extended so that the plug thereon extends into and through the compaction chamber. The concrete conveyor 76 then begins dumping concrete into the hopper 54. As the concrete is dumped into the hopper 54, the outer end of the support member 42 moves upwardly due to the weight of the concrete in the hopper 54. When the proper amount of concrete, as determined by the weight thereof, is reached the outer end of the support member 42 engages the upper switch 70, the concrete conveyor 76 stops and the hopper 54 is moved to its dumping position with the concrete in the hopper dumping into the upper end of the chute 78. At this time, the shot glass assembly will be in the position of FIG. 7. After the hopper 54 has dumped the concrete therefrom, the hopper 54 returns to its non-dumping position. At this time, the vibrator for the machine will be turned "on". The shot glass assembly 84 is then moved from the position of FIG. 7 to the position of FIG. 8. The air cylinder 120 is then extended which causes the compaction head 122 to move downwardly through the shot glass assembly 84 to the position of FIG. 11 to compact the concrete within the compaction chamber of the mold box 94. When the concrete in the compaction chamber of the mold box 94 has been compacted, the air cylinder 120 is retracted to cause the compaction head 122 to move upwardly through the shot glass assembly 84. At this time, the vibrator will stop. The end doors 110 and 114 are then automatically opened and the conveyor chain 134 is moved inwardly so that the molded block 184 in the tray 162 on the pad 148 is pushed out of the compaction chamber of the mold box 94 by a new tray being moved into the compaction chamber. The shot glass assembly 84 is then moved from the position of FIG. 8 to the position of FIG. 7. The sequence is then repeated.

Thus it can be seen that a novel and unique concrete block molding machine has been provided which accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

The invention claimed is:

1. A dry-cast concrete block molding machine, comprising:

an upstanding frame means having an upper end, a lower end, a first side, a second side, a front side and a back side;

a concrete weigh hopper positioned at said upper end of said frame means;

said concrete weigh hopper having an open upper end;

a concrete conveyor for conveying dry-cast concrete to said open upper end of said concrete weigh hopper;

said concrete weigh hopper being pivotally movable from a concrete receiving position to a dumping position;

an electronic scale associated with said weigh hopper which causes said weigh hopper to move to its dumping position when the dry-cast concrete in said weigh hopper reaches a predetermined weight, a concrete chute mounted on said frame means below said concrete weigh hopper;

said concrete chute having an open upper end and an open lower end;

a shot glass assembly positioned below said concrete chute which is selectively horizontally movably mounted on said frame means between a first position and a second position;

said shot glass assembly having an open upper end and an open lower end;

said shot glass assembly, when in said first position, having its open upper end positioned directly below said open lower end of said concrete chute so that dry-cast concrete dumped from said concrete weigh hopper into said open upper end of said concrete chute will pass downwardly into said open upper end of said shot glass assembly;

said shot glass assembly, when in its said second position, having its open upper end positioned laterally of said open lower end of said concrete chute;

concrete block mold box mounted on said frame means which is positioned directly below said open lower end of said shot glass assembly when said shot glass assembly is in its said second position;

said concrete block mold box including a bottom wall, an upstanding front side, an upstanding back side, an open first end and an open second end;

an upstanding first mold box end plate which is selectively horizontally movably mounted on said frame means;

said first mold box end plate being selectively horizontally movable on said frame means between open and closed positions relative to said mold box;

said first mold box end plate, when in its said dosed position, closing said open first end of said mold box;

an upstanding second mold box end plate which is selectively horizontally movably mounted on said frame means;

said second mold box end plate being selectively horizontally movable on said frame means between open and closed positions relative to said mold box;

said second mold box end plate, when in its said dosed positions, closing said open second end of said mold box;

a horizontally disposed pad conveyor, having first and second ends, positioned at said first side of said frame means;

a plurality of horizontally disposed metal pads positioned on said pad conveyor in an end-to-end manner;

each of said metal pads having an outer end, an inner end, opposite edges, an upper surface and a lower surface;

a mold tray positioned on each of said metal pads;

each of said mold trays including a bottom wall with inner and outer surfaces, an upstanding outer end wall with inner and outer surfaces and an upper end;

an upstanding inner end wall with inner and outer surfaces and an upper end; an upstanding first side wall with inner and outer surfaces and an upper end; an upstanding second side wall with inner and outer surfaces and an upper end;

said inner surfaces of said bottom wall and said end walls and said side walls of side mold tray defining a concrete receiving cavity;

said inner surface of said bottom wall of said mold tray having an irregular surface with indentations and ridges formed therein;

said pad conveyor configured to convey pads and tray molds thereon sequentially into said mold box whereby the lower surface of the metal pad is positioned on said bottom wall of said mold box;

a vertically disposed first power cylinder mounted on said frame means including a cylinder body and a cylinder rod selectively movably extending downwardly therefrom;

said cylinder body of said first power cylinder being positioned above said mold box above said shot glass assembly;

said cylinder rod of said first power cylinder being selectively movable between retracted and extended positions;

a compaction head on said cylinder rod of said first power cylinder so that extension of said cylinder rod of said first power cylinder causes the compaction head to move downwardly through said shot glass assembly, when said shot glass assembly is in its said second position, to force the dry-cast concrete therein downwardly into said mold box, and into said concrete receiving cavity in the tray mold positioned in said mold box, when said first and second mold box and plates are in their said closed positions, to compact the dry-cast concrete in the mold box and tray mold therein;

said first and second mold box end plates being movable from their said closed positions to their said open positions, after the dry-cast concrete has been compacted in said mold box and the tray mold therein after said cylinder rod of said first power cylinder has been moved to its retracted position;

the subsequent activation of said pad conveyor causing another metal pad and tray mold therein to enter said mold box with the molded concrete block, metal pad and tray mold being pushed out of the mold box by the incoming metal pad and tray mold.

2. The machine of claim 1 wherein mold plates are selectively removably secured to said front and back sides of said mold box.

3. The machine of claim 1 where said front side of said mold box engages said outer surface of said first side wall of the tray mold positioned therein, said back side of said mold box engages said outer surface of said second side wall of the tray mold positioned therein, said first mold box end plate, when in said dosed position, engaging said outer surface of said inner end well of the tray mold positioned therein, said second mold box end plate, when in said closed position, engaging said outer surface of said outer end wall of the tray mold therein.

4. The machine of claim 1 wherein each of said metal pads has an upstanding lug extending upwardly from said upper surface thereof adjacent said outer end thereof, the tray mold on said metal pad having its outer end wall positioned adjacent said lug.

* * * * *